US007931487B1

(12) United States Patent
Cappuccio et al.

(10) Patent No.: US 7,931,487 B1
(45) Date of Patent: Apr. 26, 2011

(54) ELECTRICAL TERMINAL CONNECTOR AND METHOD OF CONNECTION

(76) Inventors: Louis W. Cappuccio, Hammonton, NJ (US); Jose Rodriguez, Hammonton, NJ (US)

( * ) Notice: Subject to any disclaimer, the term of this patent is extended or adjusted under 35 U.S.C. 154(b) by 0 days.

(21) Appl. No.: 12/799,314

(22) Filed: Apr. 22, 2010

(51) Int. Cl.
*H01R 4/24* (2006.01)

(52) U.S. Cl. ..... 439/395; 439/418; 439/427

(58) Field of Classification Search ..... 439/388, 439/391, 395, 399, 402, 404, 418, 424, 427
See application file for complete search history.

(56) References Cited

U.S. PATENT DOCUMENTS 1,631,719 A * 6/1927 Chandler ..... 403/283
2,604,508 A * 7/1952 Bergan ..... 174/84 C
2,753,392 A * 7/1956 Hebeler ..... 174/84 S
3,320,354 A * 5/1967 Marley et al. ..... 174/84 C
3,744,007 A * 7/1973 Horak ..... 439/394
3,814,836 A * 6/1974 Neale, Sr. ..... 174/84 C
4,075,417 A * 2/1978 Neale, Sr. ..... 174/84 C
4,310,719 A * 1/1982 Cross et al. ..... 174/94 R
5,607,320 A * 3/1997 Wright ..... 439/394
5,658,163 A * 8/1997 DeRoss ..... 439/424
6,278,061 B1 * 8/2001 Daoud ..... 174/659

* cited by examiner

*Primary Examiner* — James Harvey
(74) *Attorney, Agent, or Firm* — Stuart M. Goldstein

(57) ABSTRACT

A connector for providing an electrical connection between two insulated covered electrical wires consists of a cylindrical member made of electricity conductive metal. The cylindrical member is made from a flexible plate appropriately rolled and configured to include two cylindrical elements interconnected by an intermediate section. The cylindrical elements each have a plurality of sharp blade elements which form jagged serrated edges around the perimeter of one end of each element. Insulated electrical wires are pushed through the cylindrical elements and their serrated edges and then pulled back. This causes the blade elements to pierce the insulation around the electrical wires, thus forming a secure electrical connection between the wires and the cylindrical member.

9 Claims, 4 Drawing Sheets

ELECTRICAL TERMINAL CONNECTOR AND METHOD OF CONNECTION

BACKGROUND OF THE INVENTION

Manual connection of insulated electrical wire is a necessary, but generally a slow and inexact process. The correct length of wire insulation must be carefully cut and stripped off, which sometimes results in damage to the conductive metal wire component. The metal ends of the wires must then be crimped properly to ensure a secure electrical connection. If the connection results in exposed wires, electrical tape or a similar protective insulation covering must be applied. There is currently no simpler and effective means of accomplishing electrical wire connections without compromising the integrity of the electrical connection.

SUMMARY OF THE INVENTION

It is thus the object of the present invention to provide a unique, simpler, more efficient and effective means of connecting electrical wire.

It is the object of the present invention to provide an electrical connector which can be used to connect electrical wire of a multitude of sizes and gauges.

It is another object of the present invention to provide an electrical connector which eliminates the stripping and crimping of electrical wire in the wire connection process.

It is a further object of the present invention to provide an electrical connector which provides a secure and effective electrical connection between wires.

It is still another object of the present invention to provide an electrical connector which consists of a single component and is thus economically and easily manufactured.

These and other objects are accomplished by the present invention, a connector for providing an electrical connection between two insulated covered electrical wires consisting of a cylindrical member made of electricity conductive metal. The cylindrical member is made from a flexible plate appropriately rolled and configured to include two cylindrical elements interconnected by an intermediate section. The cylindrical elements each have a plurality of sharp blade elements which form jagged serrated edges around the perimeter of one end of each element. Insulated electrical wires are pushed through the cylindrical elements and their serrated edges and then pulled back. This causes the blade elements to pierce the insulation around the electrical wires, thus forming a secure electrical connection between the wires and the cylindrical member.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
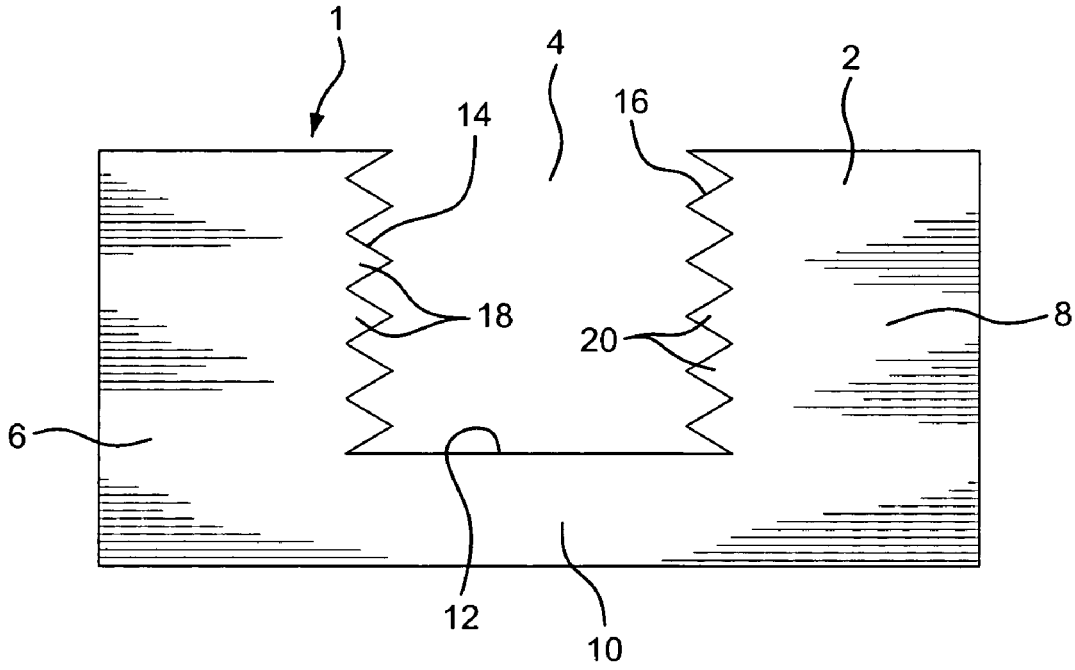
FIG. 1 is a top view of the plate used to form the connector of the present invention.
Figure 2:
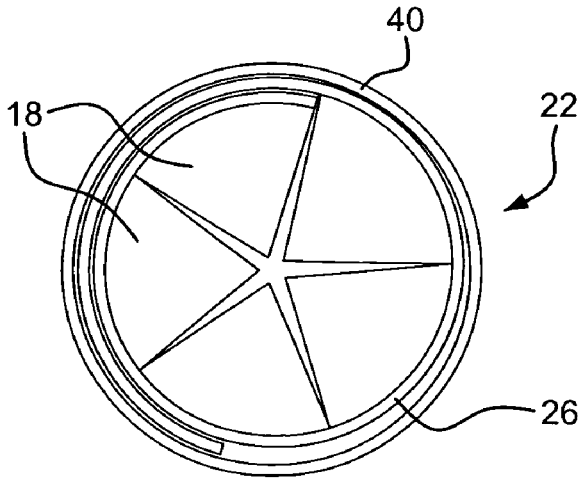
FIG. 2 is a end view of the electrical connector of the present invention.
Figure 3:
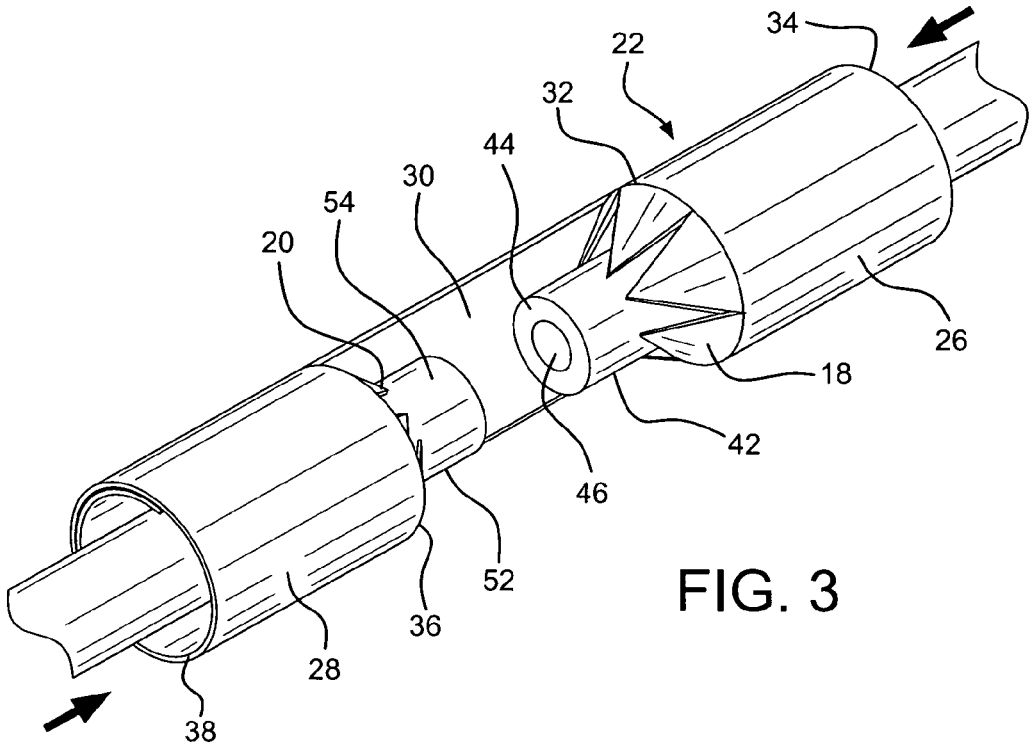
FIG. 3 is a perspective view of the electrical connector of the present invention with electrical wires being pushed through the connector.
Figure 4:
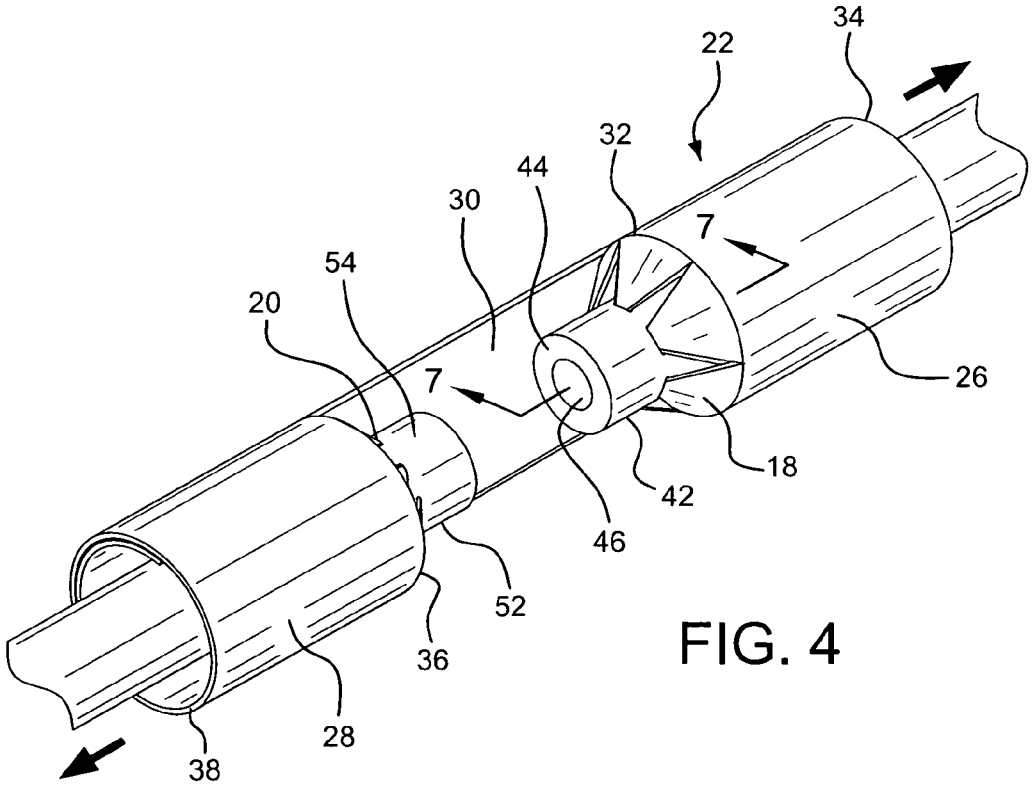
FIG. 4 is a perspective view of the electrical connector of the present invention with electrical wires being pulled out of the connector to form an electrical connection.

Electrical connector 1 comprises relatively flat, flexible plate 2 made of copper, aluminum, or other electricity conductive metal. Plate 2 has cut-out section 4, and side sections 6 and 8 interconnected by intermediate section 10. Cut-out section 4 comprises straight rear surface 12 and lateral surfaces 14 and 16. Each lateral surface is formed by a plurality of sharp blade elements 18 on lateral surface 14, and 20 on lateral surface 16. Blade elements 18 and 20 result in the formation of jagged, serrated edges extending along lateral surface 14 and 16.

Figure 5:
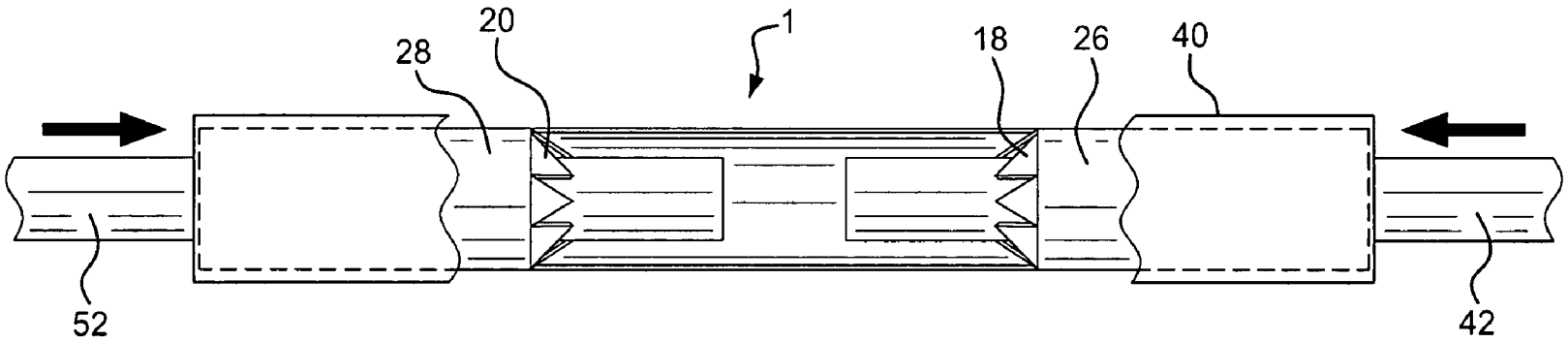
FIG. 5 is an elevation view of that which is shown in FIG. 3, also including the connector's tube covering.
Figure 6:
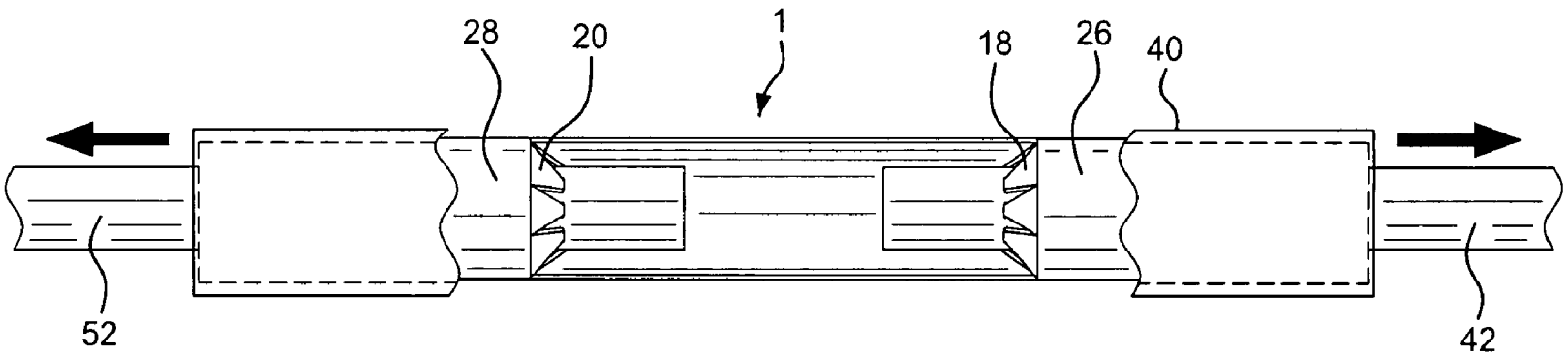
FIG. 6 is an elevation view of that which is shown in FIG. 4, also including the connector's tube covering.

Plate 2 of connector 1 is configured to be rolled into cylindrical member 22. Side sections 6 and 8 become cylindrical elements 26 and 28. Intermediate section 10 now becomes curved intermediate section 30, interconnecting elements 26 and 28. Element 26 has ends 32 and 34, end 32 having blade elements 18 extending around the perimeter of the end and end 34 being open. Element 28 has ends 36 and 38, end 36 having blade elements 20 extending around the perimeter of the end and end 38 being open. Tube 40, shown in FIGS. 5 and 6, is made of lightweight plastic or similar material and is provided to cover and protect cylindrical member 22.

Figure 7:
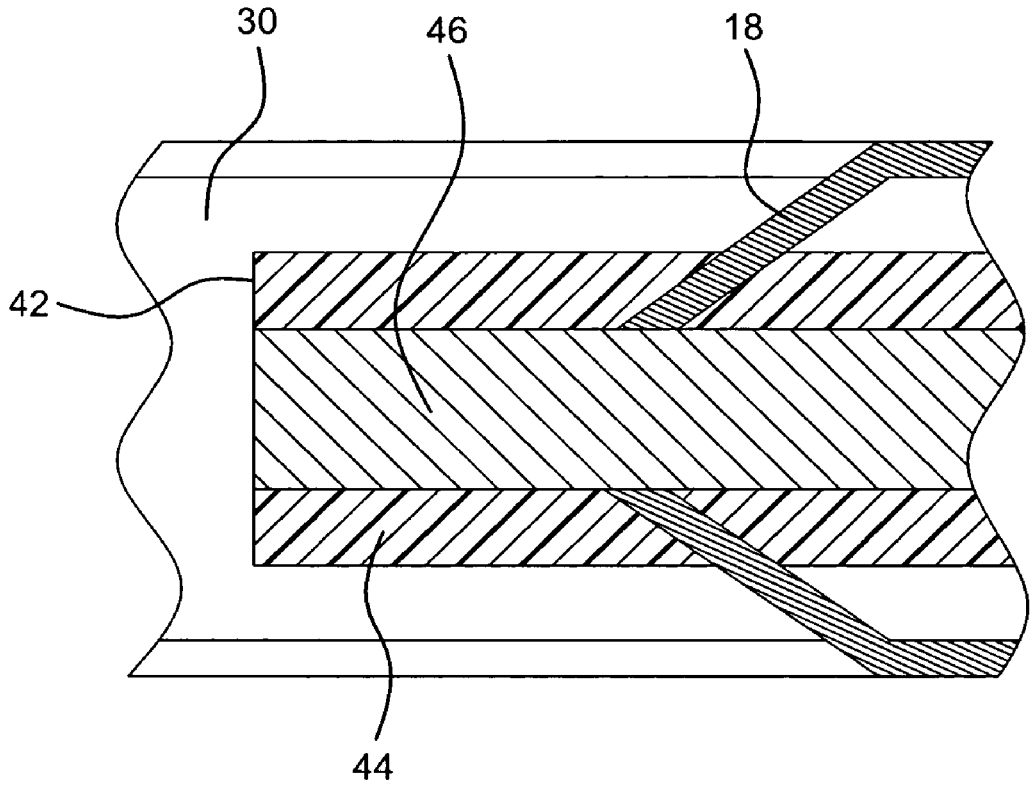
FIG. 7 is a cross-sectional view taken from FIG. 4.

In use, electrical wire 42 having insulation 44 and electricity conductive metal wire component 46, is pushed through open end 34 and then through end 32 and blade elements 18 of element 26. Wire 42 is then pulled sharply back. This action causes blade elements 18 to pierce through insulation 44 and contact metal wire component 46. This results in electricity conductive, metal to metal connection between cylindrical element 22 and wire 42. (See FIG. 7).

In like manner, electrical wire 52 has insulation 54 and electricity conductive metal wire component identical to that which is shown with regard to wire 42. (See FIG. 7). Wire 52 is pushed through open end 38 and then through end 36 and blade elements 20 of cylindrical element 28. Wire 52 is then pulled sharply back. This action causes blade elements 20 to pierce through insulation 54 and contact the metal wire component of wire 52. This results in electricity conductive, metal to metal connection between cylindrical member 22 and wire 52. When wire 42 is in place in cylindrical member 22, it also results in the secure electrical connection between wires 42 and 52.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A connector for providing an electrical connection between two insulated covered electrical wires, said connector comprising:

a flexible plate made of electricity conductive material, said plate comprising an internal cut out section having a substantially straight rear surface and two lateral surfaces, each lateral surface comprising a plurality of sharp, blade elements, the blade elements forming jagged, serrated edges, one jagged edge extending along the length of each lateral surface, whereby the plate is configured to be formed into a cylindrical member and each jagged edge is configured to accept an insulated covered electrical wire, to pierce the insulation from the wire, and secure the wire within the connector.

2. The connector as in claim 1 wherein the cylindrical member forms an electrical connection between the wires.

3. The connector as in claim 1 wherein the cylindrical member comprises two cylindrical elements interconnected by an intermediate section.

4. The connector as in claim 1 wherein the plate further comprises two side sections interconnected by an intermediate section.

5. A connector for providing an electrical connection between two insulated covered electric wires, said connector comprising:

a cylindrical member made of electricity conductive material, said member comprising two cylindrical elements each having a first end and a second end, each said end having a given perimeter, and a plurality of sharp blade elements forming a jagged serrated edge, one jagged edge extending around the perimeter of one end of each of the two elements, whereby each jagged end is configured to accept an insulated covered electric wire, to pierce the insulation from the wire, and to secure the wire within the cylindrical member.

6. The connector as in claim 5 further comprising an intermediate section interconnecting the elements.

7. The connector as in claim 5 further comprising a connector tube covering the cylindrical member.

8. A connector as in claim 5 wherein the cylindrical member forms an electrical connection between the wires located within the connector.

9. A method of electrically connecting two insulation covered electrical wires, the steps of the method comprising:

providing a cylindrical member made of electricity conductive material, said member comprising two cylindrical elements each having a first end and a second end, each said end having a perimeter, and a plurality of sharp blade elements forming a jagged serrated edge, one jagged edge extending around the perimeter of one end of each of the two elements;

pushing the free end of a first electrical wire through the jagged edge extending around the perimeter of one end of a first cylindrical element;

pulling back on the first wire;

piercing through the insulation of the first wire by the action of the serrated edge of the first cylindrical element against the free end of the first wire, thus securing the first wire within the first cylindrical element and establishing an electrical connection between the first wire and the first cylindrical element;

pushing the free end of a second electrical wire through the jagged serrated edge extending around the perimeter of one end of the second cylindrical element;

pulling back on the second wire;

piercing through the insulation of the second wire by the action of the serrated edge of the second cylindrical element against the free end of the second wire, thus securing the second wire within the second cylindrical element and establishing an electrical connection between the second wire and the second cylindrical element; and establishing a connection between the cylindrical member and the first and second wires.

* * * * *